US009434457B2

(12) United States Patent
Volland et al.

(10) Patent No.: US 9,434,457 B2
(45) Date of Patent: Sep. 6, 2016

(54) BOAT LAUNCH

(71) Applicant: KME Germany GmbH & Co. KG, Osnabrück (DE)

(72) Inventors: Michael Volland, Wallenhorst (DE); Markus Seehöfer, Melle (DE); Reinhard Hintemann, Osnabrück (DE); Bernd Sagebiel, Dessau-Rosslau (DE)

(73) Assignee: KME GERMANY GMBH & CO. KG, Osnabrück (DE)

( * ) Notice: Subject to any disclaimer, the term of this patent is extended or adjusted under 35 U.S.C. 154(b) by 0 days.

(21) Appl. No.: 14/432,698

(22) PCT Filed: Aug. 19, 2013

(86) PCT No.: PCT/DE2013/000464

§ 371 (c)(1),
(2) Date: Mar. 31, 2015

(87) PCT Pub. No.: WO2014/053107

PCT Pub. Date: Apr. 10, 2014

(65) Prior Publication Data

US 2015/0274268 A1 Oct. 1, 2015

(30) Foreign Application Priority Data

Oct. 5, 2012 (DE) ..... 10 2012 019 554

(51) Int. Cl.
*B63B 27/30* (2006.01)
*B63C 3/00* (2006.01)
(Continued)

(52) U.S. Cl.
CPC ..... *B63C 3/00* (2013.01); *B63B 21/00* (2013.01); *B63B 27/30* (2013.01); *E02B 3/20* (2013.01); *E02B 17/003* (2013.01); *E02B 17/0026* (2013.01); *E06C 9/02* (2013.01); *B63B 2021/003* (2013.01)

(58) Field of Classification Search
CPC ..... B63B 27/00; B63B 27/30
USPC ..... 114/362
See application file for complete search history.

(56) References Cited

U.S. PATENT DOCUMENTS 2,791,096 A 5/1957 Morton et at
4,542,846 A * 9/1985 Matsui ..... B23K 20/129 228/114.5

(Continued)

FOREIGN PATENT DOCUMENTS

CN 2088631 U * 11/1991
EP 2 316 584 5/2011

(Continued)

OTHER PUBLICATIONS

Machine Translation of Chinese Patent CN 2088631U, Mar. 14, 2016, 3 pages.*

(Continued)

*Primary Examiner* — Sunil Singh
(74) *Attorney, Agent, or Firm* — Henry M. Feiereisen LLC

(57) ABSTRACT

A boat launch for the pillars of offshore installations includes fender pipes extending substantially perpendicularly to sea level and a ladder being positioned closer to the pillars than the fender pipes. The fender pipes have an inner pipe consisting of steel that is not resistant to seawater and an outer pipe consisting of a seawater resistant metal alloy.

3 Claims, 3 Drawing Sheets

(51) Int. Cl.

| | |
|---|---|
| ***E02B 17/00*** | (2006.01) |
| ***E06C 9/02*** | (2006.01) |
| ***E02B 3/20*** | (2006.01) |
| ***B63B 21/00*** | (2006.01) |

(56) References Cited

U.S. PATENT DOCUMENTS

| | | | | |
|---|---|---|---|---|
| 2001/0042297 | A1* | 11/2001 | Wolf | B21C 1/24 29/458 |
| 2011/0100804 | A1 | 5/2011 | Krone et al. | |

FOREIGN PATENT DOCUMENTS

| | | | | |
|---|---|---|---|---|
| GB | 2480408 | | | 11/2011 |
| GB | 2481152 | A | * | 12/2011 |
| GB | 2485556 | | | 6/2012 |
| JP | 01148448 | A | * | 6/1989 |
| KR | 2001044732 | A | * | 6/2001 |
| KR | 2008107903 | A | * | 12/2008 |
| WO | WO 2012047096 | A1 | * | 4/2012 |
| WO | WO2012/066349 | | | 5/2012 |

OTHER PUBLICATIONS

International Search Report issued by the European Patent Office in International Application PCT/DE2013/000464.

Chinese Search Report issued on May 31, 2016 with respect to counterpart Chinese patent application 201380051948.3.

Translation of Chinese Search Report issued on May 31, 2016 with respect to counterpart Chinese patent application 201380051948.3.

* cited by examiner

BOAT LAUNCH

CROSS-REFERENCES TO RELATED APPLICATIONS

This application is the U.S. National Stage of International Application No. PCT/DE2013/000464, filed Aug. 19, 2013, which designated the United States and has been published as International Publication No. WO 2014/053107 and which claims the priority of German Patent Application, Serial No, 10 2012 019 554.0, filed Oct. 5, 2012, pursuant to 35 U.S.C. 119(a)-(d).

BACKGROUND OF THE INVENTION

The invention relates to a boat launch for pillars of offshore installations.

Offshore installations, in particular wind turbines, must be serviced at regular intervals. For this purpose, a maintenance crew is transferred by boat to the offshore installation. The boat is thus brought close to a boat launch, which is attached to a pillar of such offshore installation. The boat launch consists of two vertical fender pipes. The bow of the boat is typically pushed against the fender pipes, allowing the maintenance crew to climb up a ladder that is located closer to the pillar than the fender pipes. The fender pipes protect the maintenance crew before the pressure exerted by boat to the fender pipes when climbing up the ladder.

Rough seas and the tidal range cause significant friction between the boat and the fender pipes. The stiff fender pipes are made of steel and are covered with an anti-corrosion layer, usually a paint finish capable of withstanding the high mechanical loads and the harsh environment. To protect the fender pipes, fenders are arranged on the mooring boat. These may be rubber buffers that prevent a metallic contact between the boat and the fender pipes. The fender pipes are quickly damaged due to the unavoidable relative movement between the fender pipes and the boats. Early corrosion man be detected despite a protective coating. On the other hand, a very long service life is expected from offshore installations, in particular wind turbines. A service life of 20 years assumes that the boat launches also have a corresponding service life. The foundations of offshore installations, in particular made of steel, have much greater wall thicknesses than the fender pipes so that it can be expected that the fender pipes must be replaced before the end of 20 years. Repeated painting of the fender pipes or replacement of the entire boat launch is possible, but expensive.

SUMMARY OF THE INVENTION

It is the object of the invention to demonstrate a boat launch for pillars of offshore installations, which is characterized by a longer service life.

This object is attained with a boat launch for pillars of offshore installations having fender pipes constructed from an inner pipe made of steel that is not resistant to seawater and an outer pipe made of a seawater-resistant metal alloy, with the fender pipes extending substantially perpendicular to sea level and being spaced from the pillars, and a ladder arranged closer to the pillars than the fender pipes.

The boat launch has further advantageous embodiments of the invention.

This structure made of two different pipes has the advantage that a low-cost steel that is not resistant to seawater can be used as supporting substructure. The outer pipe protects the substructure from attack by the seawater. In addition, an outer pipe made of a metal alloy resistant to seawater is in any event more durable than a coat of paint or a jacket in the form of a plastic film which is subject to aging due to UV exposure and which can be damaged mechanically, e.g. by floating debris. An outer pipe made of a suitable metal alloy is by far superior to all other corrosion coatings for specific applications.

Since the fender pipes, which usually have a diameter of 200 mm to 800 mm, are located at a greater distance from the pillar than the ladders that are protected by the fender pipes, supporting or connection pipes are required to connect the fender pipes with the pillars. These supporting pipes can also be constructed of two shells, i.e. they may have an inner pipe of steel that is not resistant to seawater and an outer pipe made of a metal alloy resistant to seawater. The diameter range of the supporting pipes is preferably in a range of 80 mm to 200 mm.

The ladder itself and the struts connecting the ladder to the fender pipes can also consist exclusively of a metal alloy resistant to seawater. This can be a solid material or a hollow material. The diameter of the ladder rails may be between 60 mm and 200 mm. A hollow material is preferably used with these diameter ranges, as well as for the struts themselves. Of course, the same two-part structure as for the fender pipes is also possible.

The ladder rungs may be made of a square material in a diameter range of 20 mm to 60 mm. Here, preferably a solid material is used.

The outer pipe of the fender pipe is preferably a seamless drawn pipe. Seamless drawn pipes have no welds. The homogeneous structure provides fewer points of attack for corrosive influences. A seamless drawn pipe has naturally no welds and therefore no welding additives nor does it undergo structural change caused by welding, which could increase the risk of corrosion.

In the context of the invention, it is of course not excluded that the outer pipe is also a welded pipe, either with a helical weld or a longitudinal seam weld.

Preferably, the outer pipe and the inner pipe are connected to each other in a force-locked manner. This applies to all double-walled pipes of the boat launch according to the invention. A force-locked connection can be produced in particular by pressing the outer pipe onto the inner pipe. This can be performed with a draw bench, by means of which the outer pipe is essentially pulled onto the inner pipe. This creates a soundproof connection, i.e. the two pipes are firmly seated on each other without gap. The force-locked connection does not permit any relative displacement of the inner pipe relative to the outer pipe. The fender pipe behaves as a single unit, only with different material properties on the inside and the outside.

The wall thickness of the outer pipes is preferably in a range of 1 mm to 10 mm. This wall thickness is sufficient to withstand even severe mechanical stresses. It should be noted here that mechanical stresses are caused not only when a boat is moored, but also by the mechanical removal of adhesions, such as barnacles, which is necessary from time to time. This applies particularly to the area of the ladder, which should allow safe passage by the maintenance crew to the offshore installation.

It is considered particularly advantageous when the metal alloys resistant to seawater are copper based alloys, because these have in addition to excellent resistance to seawater also a unique antifouling property against marine organisms, in particular copper-nickel alloys with 70 to 90% copper, balance nickel and melt-induced impurities.

Alternatively, nickel alloys are suitable, such as Alloy 400 are (European material number 2.4360, American UNS N04400) and Alloy 825 (European Material No. 2.4858).

High-alloy stainless steels resistant to seawater, duplex steels or super duplex steels can also be used.

The corrosion resistance of copper-nickel alloys improves with increasing nickel content.

Simple, bearing steels can be used as material for the inner pipes, because the inner pipes have only a supporting function. Resistance to seawater is hereby unimportant, since this task is handled exclusively by the outer pipes. The wall thickness of the inner pipes is greater than the wall thickness of the outer pipes due to the supporting function, for example by a factor of 2 to 10.

It will be understood that the insides of the fender pipes must be protected from entry of seawater. Consequently, the ends of the fender pipes are sealed watertight. The various components of the boat launch are preferably welded together. To protect the weld seams against corrosion attacks, these have preferably a nickel content of 25% to 95% when the metal alloys resistant to seawater are copper-based or nickel-based alloys. Suitable corrosion resistant welding materials are used when stainless steels are employed.

BRIEF DESCRIPTION OF THE DRAWING

The invention will now be described in more detail with reference to an exemplary embodiment shown in the drawings, which show in.

DETAILED DESCRIPTION OF PREFERRED EMBODIMENTS

Figure 1:
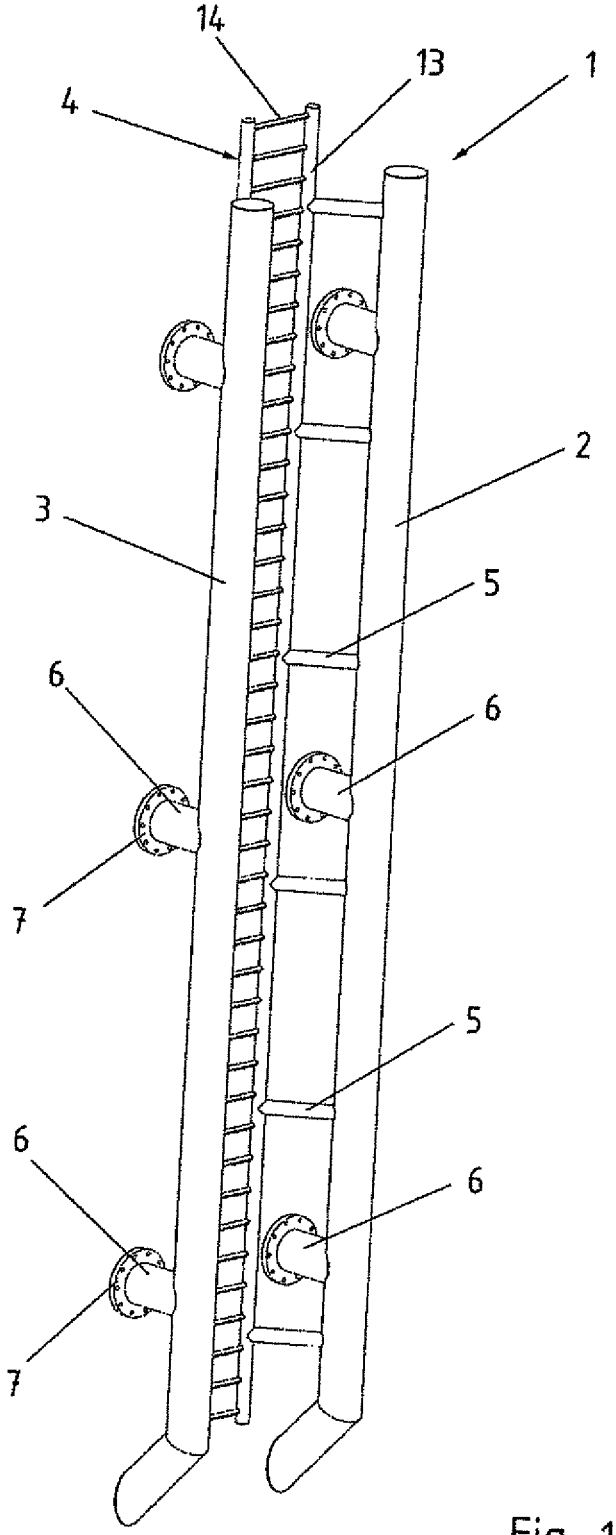
FIG. 1 a boat launch in perspective view.

FIG. 1 shows a boat launch 1, which is attached to a pillar of an offshore installation in a manner not shown. The pillar may for example be the pillar a wind turbine.

The boat launch 1 is composed of two fender pipes 2, 3, which are arranged parallel to one another and extend substantially perpendicularly to the sea level. The exact orientation depends on the pillar, not shown in detail. Theoretically, the boat launch 1 can also be slightly inclined when the pillar is tapered upwards. The bottom ends of the fender pipes 2, 3 are angled in the direction toward the pillar. This prevents a boat from getting caught at the fender pipes 2, 3 in heavy seas.

A ladder 4 is disposed between the two fender pipes 2, 3. A boat that transfers a maintenance crew to the offshore installation moves against the fender pipes 2, 3 with its bow. A person can now exit the boat and climb onto a ladder 4 between the two fender pipes 2, 3 and then climb onto an unillustrated platform above the fender pipes 2, 3, or into the pillar of the offshore installation through an opening.

Figure 4:
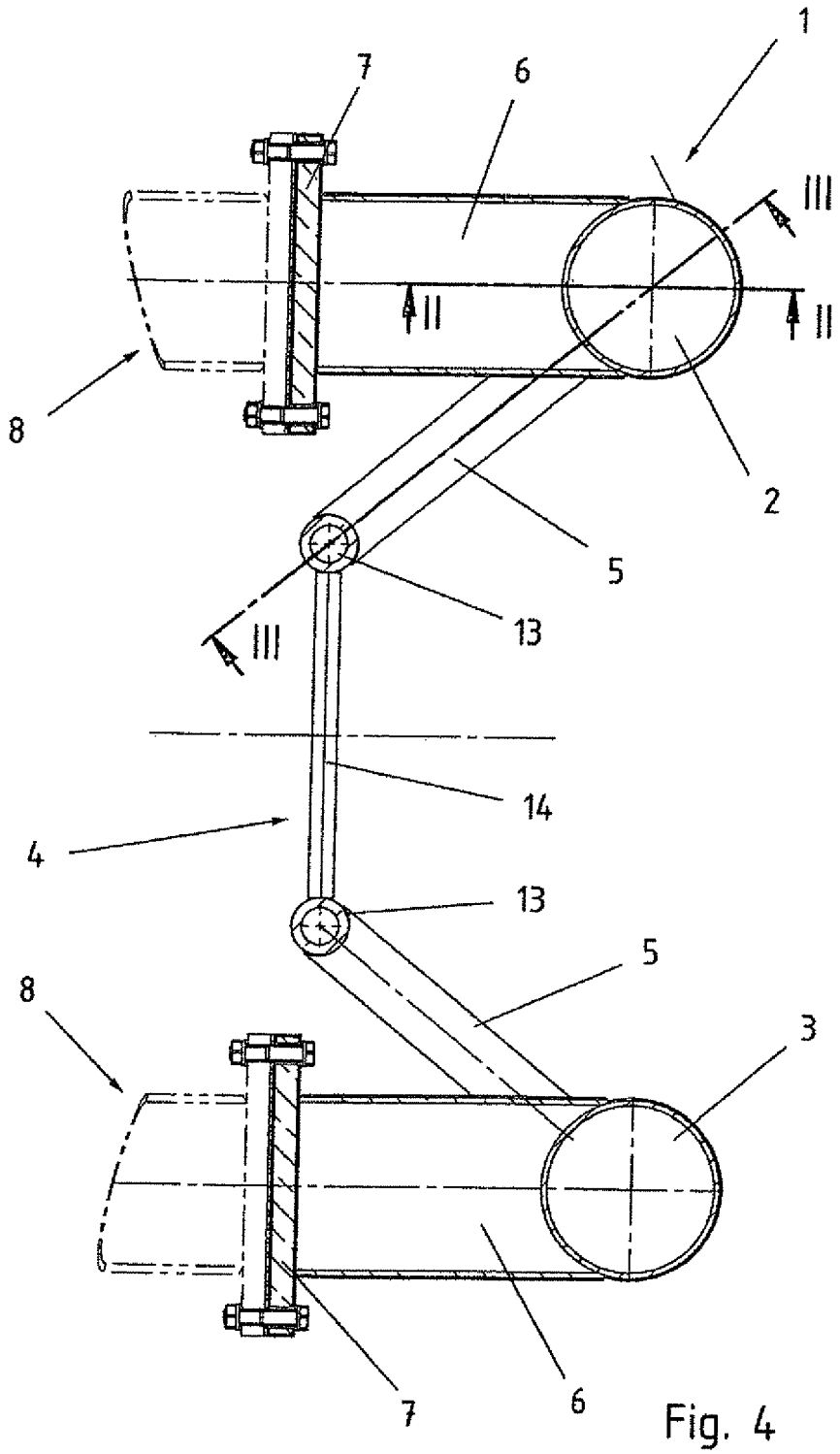

The ladder 4 is held by way of struts 5, which are connected to the fender pipes 2, 3. The fender pipes 2, 3 themselves are connected by transverse outgoing support pipes 6 with screw flanges 7 to an unillustrated supporting structure of the pillar. FIG. 4 indicates schematically the supporting structure 8, which is associated with the pillar and serves to secure the boat launch 1.

Figure 2:
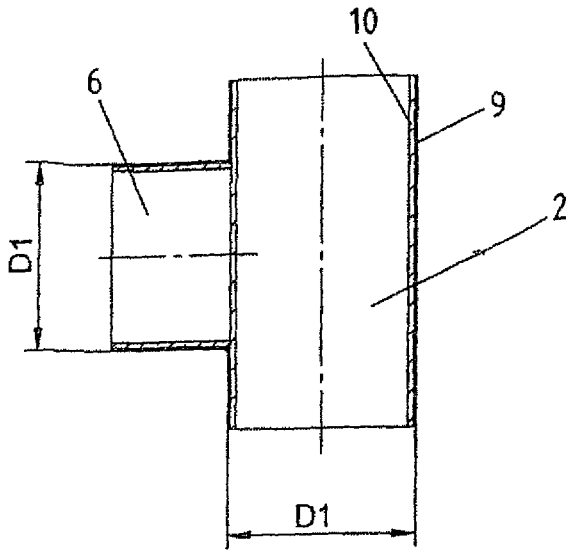
FIG. 2 a longitudinal section through a fender pipe along the line II-II in FIG. 4, FIG. 3 a cross section through a strut between the fender pipe and a ladder along the line III-III of FIG. 4, and FIG. 4 a cross section through the boat launch of FIG. 1.

FIG. 2 shows a fender pipe 2 in cross section along the line of FIG. 4. The structure is double walled. The fender pipe 2 has an outer pipe 9 and an inner pipe 10. The outer pipe 9 is composed of a seawater-resistant metal alloy, which in this exemplary embodiment a copper-nickel alloy CuNi90/10. The inner pipe 10 is made of a steel that is not resistant to seawater, in this exemplary embodiment S355J2H.

As can be seen, the fender pipe 2 and the transversely outgoing support pipe 6 have the same diameter D1, which in this exemplary embodiment is between 300 mm and 400 mm. In terms of the materials, the structure of the support pipe 6 is identical to the structure of the fender pipes 2, 3. The fender pipe 2 is welded to the support pipe 6.

Figure 3:
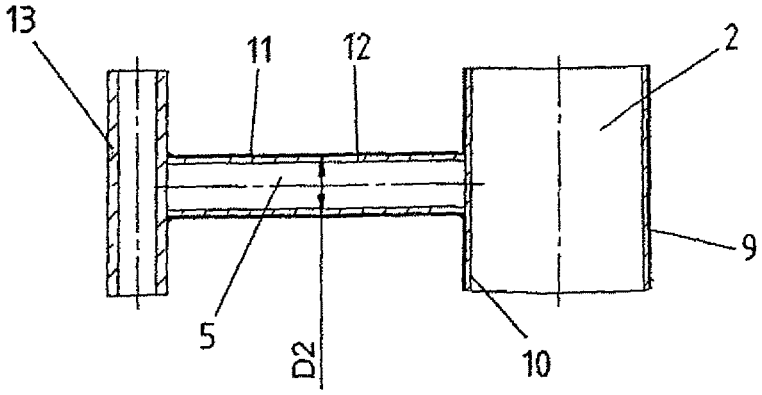

The strut 5 can consist solely of a seawater-resistant material. However, FIG. 3 shows a cross-section in the region of a strut 5. The strut 5 which is a hollow profile having a circular cross-section and also constructed double-layered and has on the outside an outer pipe 11 made of a seawater-resistant metal alloy. A supporting inner pipe 12 made of steel is disposed on the inside. This is the same pair of materials as used for the fender pipe 2 and the support pipe 6, i.e. CuNi90/10 and S355J2H.

The pipe extending vertically at the left side in the image plane left is a ladder rail 13, which is also a hollow profile. The ladder rail 13 has the same outer diameter D2 as the strut 5, however, with the difference that the ladder rail 13 is composed solely of a seawater-resistant metal alloy. In this case, this is the same alloy as used for the outer pipes 9, 11 of the fender pipe 2 and/or the strut 5, i.e. CuNi90/10.

The ladder rail 13 carries rungs 14. The rungs 14 are also made of a seawater-resistant metal alloy, in this case a square profile made of CuNi90/10.

As evident from FIG. 4, the struts 5 are arranged at about a 45° angle relative to the support pipes 6. The support pipes 6 are welded to the flanges 7, which in this exemplary embodiment are made of the steel S355NL and are sheathed on the outside with a layer CuNi90/10.

The boat launch has hence no surface areas that made of a metal alloy that is not resistant to seawater. Preferably, the same metal alloy is utilized.

The invention claimed is:

1. A boat launch for pillars of offshore installations, the boat launch comprising:

fender pipes constructed from an inner pipe made of steel that is not resistant to seawater and an outer pipe made of a seawater-resistant metal alloy and connected with one another in a force-locked manner, with the fender pipes extending substantially perpendicular to sea level and being spaced from the pillars;

a ladder arranged closer to the pillars than the fender pipes;

support pipes coupling the fender pipes transversely to the pillars and constructed from an inner pipe made of steel that is not resistant to seawater and an outer pipe made of a seawater-resistant metal alloy;

struts connecting the ladder with the fender pipes, wherein the ladder and the struts are constructed exclusively of a seawater-resistant metal alloy, wherein the support pipes coupling the fender pipes transversely to the pillars are located between the struts connecting the ladder with the fender pipes as considered in a vertical direction, wherein the seawater-resistant metal alloy is selected from the group of alloys consisting of: copper based alloys, copper-nickel alloys containing from 70 to 90 wt.-% copper, with a balance of nickel and melt-induced impurities.

2. The boat launch of claim 1, wherein the outer pipe of the fender pipes is a seamlessly drawn pipe.

3. The boat launch of claim 1, wherein a wall thickness of each of the outer pipes is in a range of 1 to 10 mm.

* * * * *